US006371138B1

(12) United States Patent
Kamoto et al.

(10) Patent No.: US 6,371,138 B1
(45) Date of Patent: Apr. 16, 2002

(54) NOZZLE STRUCTURE FOR DISH WASHER

(75) Inventors: Sadamu Kamoto; Koji Suyama, both of Ohara-gun; Hiroshi Omura, Matsue; Keiichi Toga, Hikawa-gun; Toshio Nanba, Ohara-gun; Masumi Notsu, Hirata, all of (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 09/324,062

(22) Filed: Jun. 1, 1999

(51) Int. Cl.[7] ..... B08B 3/02

(52) U.S. Cl. ..... 134/172; 134/172; 134/176; 134/179; 134/200

(58) Field of Search ..... 134/172, 176, 134/179, 200, 201

(56) References Cited

U.S. PATENT DOCUMENTS 4,014,467 A * 3/1977 Ferguson
4,509,687 A * 4/1985 Cushing
4,869,428 A * 9/1989 Gombar
4,991,611 A * 2/1991 Jarvis et al.
5,427,129 A * 6/1995 Young, Jr. et al.
5,725,002 A * 3/1998 Payzant
6,044,853 A * 4/2000 Payzant

* cited by examiner

*Primary Examiner*—Frankie L. Stinson
(74) *Attorney, Agent, or Firm*—Koda & Androlia

(57) ABSTRACT

A nozzle structure for a dish washer for washing tableware with washing water and rinsing water jetted from nozzle arranged in a washing tank. The nozzle structure comprising a shaft arranged on the nozzle, a nozzle mount provided in the washing tank and formed with a mount hole, which permits removable insertion of the shaft, and a coming-off preventing means for detachably preventing the shaft inserted into the mount hole of the nozzle mount from coming off.

10 Claims, 16 Drawing Sheets

(a)

(b)

NOZZLE STRUCTURE FOR DISH WASHER

BACKGROUND OF THE INVENTION

1. Field of the Invention

The present invention relates to a nozzle structure for a dish washer, and more particularly, to a nozzle structure for a dish washer where nozzles are detachably mounted to nozzle mounts.

2. Description of the Related Art

Dish washers for automatically washing tableware such as dishes, bowls, cups and the like after table use are installed in kitchens in coffee shops, restaurants or the like and further in general homes to be widely and preferably used. Such a dish washer are constructed such that a rotatable washing nozzle and a rotatable rinsing nozzle, respectively, are provided in a washing tank to be vertically spaced from each other, and washing water and rinsing water apply their jetting reaction forces to rotate the respective nozzles and blow against tableware in a tableware rack received in the washing tank for efficient washing and rinsing.

In an exemplary nozzle structure in the dish washer, a washing tank 14 is provided with a lower rinsing nozzle mount 9, to which a shaft portion having a top opened mount hole 11 is vertically fixed, the mount hole 11 being formed with a female thread portion 11*a*. A lower rinsing nozzle 5 detachably mounted to the lower rinsing nozzle mount 9 comprises a lower rinsing nozzle holder 6 having a shape of a rectangular prism, which has horizontally lengthy sides, lower rinsing nozzle pipes 7, 7 provided in spaced relationship with each other in a lengthwise direction of the nozzle holder 6 and having a predetermined length, and a lower rinsing nozzle bolt 8 provided on an underside of the lower rinsing nozzle holder 6 to pivot the same horizontally and rotatably, and formed at its lower portion with a male thread 8*a*. The male thread 8*a* on the lower rinsing nozzle bolt 8 is threaded into the female thread portion 11*a* of the shaft portion 10 whereby the lower rinsing nozzle 5 is mounted to the lower rinsing nozzle mount 9.

In addition, a lower washing nozzle 12 having three lower washing nozzle pipes 13, 13, 13 arranged radially on a lower washing nozzle holder 15 is provided horizontally rotatably on the shaft portion 10 of the lower rinsing nozzle mount 9 through the lower washing nozzle holder 15, so that the lower washing nozzle 12 and the lower rinsing nozzle 5 are arranged in two vertical stages.

In periodically performing cleaning, inspection or repair or the like on the lower rinsing nozzle 5, it is necessary to dismount the lower rinsing nozzle 5 from the lower rinsing nozzle mount 9. However, there are raised faults that a work for loosening thread portions of the members 5, 9 to dismount the lower rinsing nozzle 5 and for mounting the nozzle after cleaning and inspection are troublesome and time consuming because the lower rinsing nozzle 5 and the lower rinsing nozzle mount 9 are threadedly mated with each other.

Further, a high temperature water at 80° C. or higher flows through the lower rinsing nozzle 5 during operation, so that the nozzle becomes very hot immediately after the operation and undergoes thermal expansion to become firm in threaded engagement, which makes the dismounting work much difficult even when such work is directly carried out with hands or with the use of a tool. Further, the work for threading the male thread 8*a* into the female thread portion 11*a* while keeping the horizontally lengthy lower rinsing nozzle 5 horizontal is troublesome, and degradation in the jetting capacity of a rinse water may be caused when the lower rinsing nozzle is mounted obliquely.

Furthermore, screw ridges on the respective thread portions 8*a*, 11*a* are possibly crushed at the time of mounting, in which case the operation is carried out in a non-positive mounting state to be in danger of the lower rinsing nozzle 5 coming off.

Also, there are pointed out defects that the fact that the above-mentioned work is time consuming may bring about a situation, in which the periodical cleaning of the lower rinsing nozzle 5 and the like is neglected to cause the lower rinsing nozzle 5 to be plugged with refuse, water scale or the like at the time of washing with the passage of time, resulting in that the washing capacity, which inherently constitutes an object and a function of the dish washer, will be degraded and an insanitary condition is caused by the propagation of various germs or the like.

SUMMARY OF THE INVENTION

The present invention is contemplated to appropriately solve the above-mentioned problems inherent in the prior art, and has its object to provide a nozzle structure for a dish washer, which enables easy mounting and dismounting nozzles to simply carry out periodical cleaning, inspection and the like for the nozzles.

To overcome the above-mentioned problems and to appropriately achieve the intended object, a nozzle structure for a dish washer for washing tableware with washing water, rinsing water or the like jetted from nozzles provided in a washing tank, according to the present invention, comprises:

a shaft arranged on the nozzle, a nozzle mount provided in the washing tank and formed with a mount hole, which permits insertion and removal of the shaft, and a coming-off preventing means for detachably preventing the shaft inserted into the mount hole of the nozzle mount from coming off.

DETAILED DESCRIPTION OF THE PREFERRED EMBODIMENTS

Figure 1:
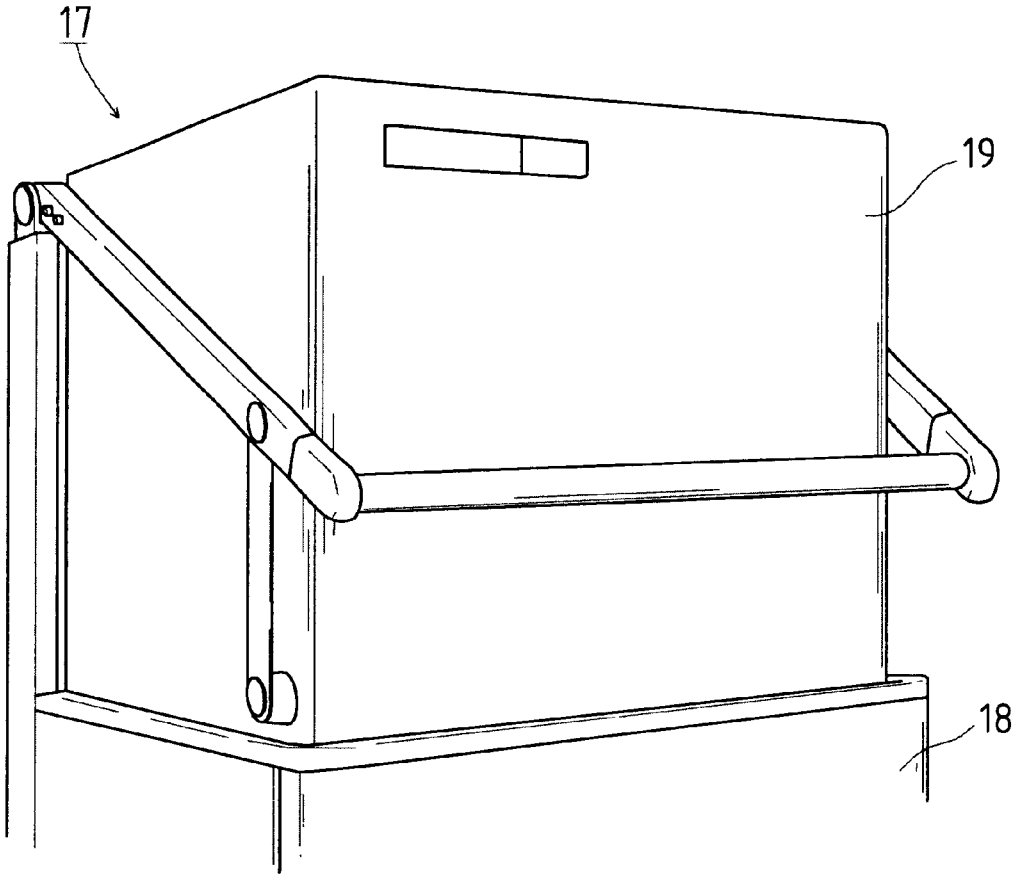
FIG. 1 is a schematic perspective view showing an essential part of a dish washer according to an embodiment of the present invention.
Figure 2:
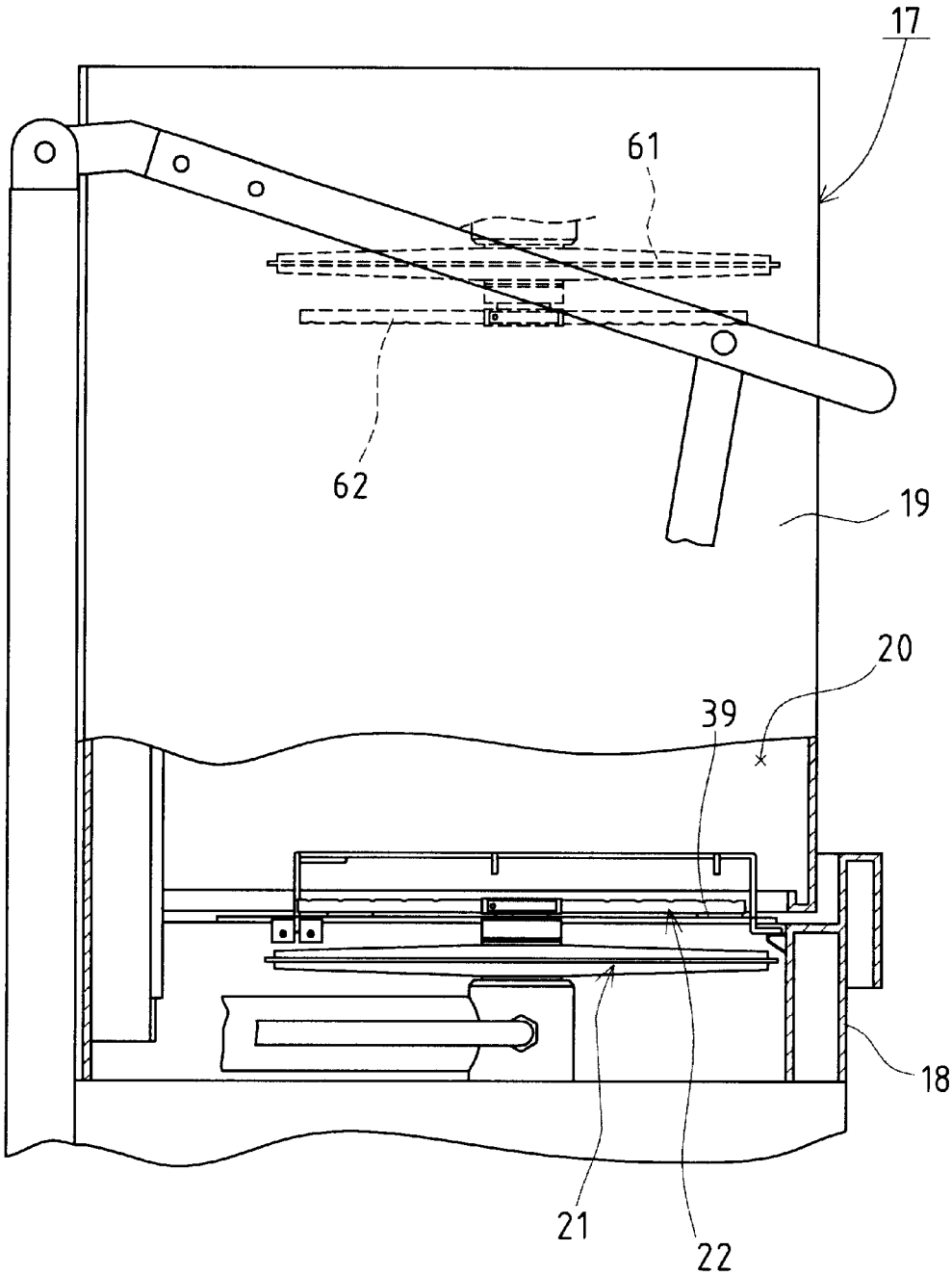
FIG. 2 is a side view showing the dish washer according to the embodiment with a part thereof broken away.

A nozzle structure for a dish washer, according to the present invention, will be described below with reference to preferred embodiments and the accompanying drawings. First, the basic construction of a dish washer, in which the nozzle structure of the present invention is employed, is described with reference to FIGS. 1 and 2. The dish washer 17 basically comprises a rectangular-shaped washing tank 18 fully opened upward, and a vertically movable casing-shaped cover body 19 capable of covering the washing tank 18 from above, the cover body 19 defining therein a washing chamber 20 in a state, in which it covers the washing tank 18. Turnably pivoted in the washing tank 18 as shown in FIG. 2 are a lower washing nozzle 21 adapted to be rotated by injection reaction of a hot water pressure fed from a hot water supply source (not shown), and a lower rinsing nozzle 22 for supplying rinsing water of high temperatures after washing. Also, pivoted through a horizontal arm (not shown) in an upper position facing the lower washing nozzle 21 and the lower rinsing nozzle 22 are an upper washing nozzle 61 and an upper rinsing nozzle 62, which function in the same manner.

(First Embodiment)

The lower rinsing nozzle 22, which constitutes the nozzle structure according to the first embodiment, basically comprises a lower rinsing nozzle holder 23 having a shape of a rectangular prism, which has horizontally lengthy sides, two lower rinsing nozzle pipes 24, 24 provided in spaced relationship with each other in a lengthwise direction of the nozzle holder 23 and having a predetermined length, and a hollow-shaped lower rinsing nozzle shaft 25 opened downward and inserted from an upper surface of the nozzle holder 23 toward a bottom surface thereof. A fitting portion 26 of the lower rinsing nozzle shaft 25 extending downwardly the lower rinsing nozzle holder 23 is formed at its entire periphery with a fitting groove 26*a*, which serves as a first fitting means (a coming-off preventing means), and is formed at its lower end with a tapered portion 26*b*. Thus, the lower rinsing nozzle 22 is adapted to be detachably mounted on a lower rinsing nozzle mount 27, which will be described hereinbelow, through the fitting portion 26 of the lower rinsing nozzle shaft 25.

In addition, a thrust washer 31 for preventing the lower rinsing nozzle shaft 25 from coming off the lower rinsing nozzle holder 23 is fitted onto the fitting portion 26 through an E-ring 33 so as not to come off. Further, the lower rinsing nozzle holder 23 is designed to be horizontally rotatable relative to the lower rinsing nozzle shaft 25, and the shaft 25 and the lower rinsing nozzle pipes 24 are in communication with each other to permit the nozzle pipes 24 to be supplied with rinsing water, which flows in the lower rinsing nozzle shaft 25.

Fixedly provided in the washing tank 18 is the cylindrical-shaped lower rinsing nozzle mount 27, on which the lower rinsing nozzle 22 is detachably mounted, the mount 27 comprising a mount hole 27*a* opened upward to permit therethrough insertion of the fitting portion 26 of the lower rinsing nozzle shaft 25, a second fitting portion 28 serving as a second fitting means (a coming-off preventing means) and having a ball-latch structure provided at a predetermined region where it fits in the fitting groove 26*a*, and an O-ring 44 for preventing leakage of water when the lower rinsing nozzle 22 is mounted, and serving as a means for preventing the lower rinsing nozzle shaft 25 from coming off the mount 27.

Figure 5:
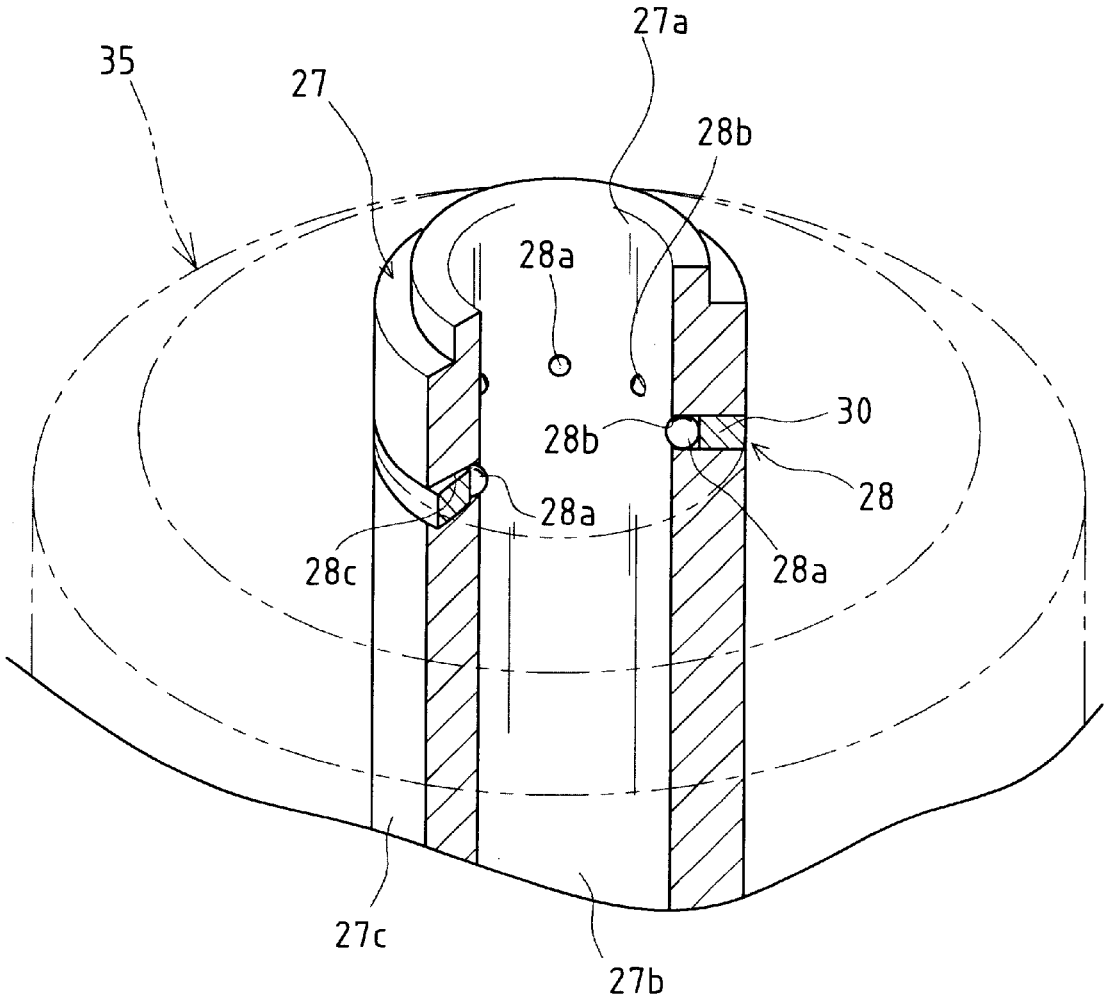
FIG. 5 is a schematic perspective view showing a lower rinsing nozzle mount in the first embodiment with a part thereof broken away.

As shown in FIG. 5, the second fitting portion 28 comprises eight latch holes 28*b* in total formed at a predetermined level on an inner wall 27*b* of the lower rinsing nozzle mount 27 to be equally spaced in a circumferential direction, a ball installation section 28*c* formed circumferentially to be opened toward an outer wall 27*c* corresponding to positions where the latch holes 28*b* are formed, eight latch balls 28*a* in total received in the ball installation section 28*c* in a state, in which they partially project inward from the latch holes 28*b*, and an elastic ring 30 inserted in the ball installation section 28*c* and serving as an elastic member for elastically biasing the latch balls 28*a* inward while allowing movements of the respective latch balls 28*a* toward the outer wall 27*c* from the latch holes 28*b*.

Thus, the latch balls 28*a* are constantly biased by the elastic ring 30 to partially project inward from the latch holes 28*b*, and are fitted into the fitting groove 26*a* to hold the lower rinsing nozzle shaft 25 in position when the fitting portion 26 of the lower rinsing nozzle shaft 25 is inserted into the mount hole 27*a*. Also, when forces are applied to push the latch balls 28*a* outward (toward the outer wall) from inward, the elastic ring 30 undergoes elastic deformation to permit the latch balls 28*a* to retreat from the latch holes 28*b*, thus permitting separation of the fitting portion 26 from the mount hole 27*a*. When the forces pushing the latch balls 28*a* outward disappear, the elastic ring 30 returns to its original configuration to permit the latch balls 28*a* to project from the inner wall 27*b* again. In addition, a hard rubber or the like is preferably used as a material for the elastic ring 30 while resin materials and iron-based materials such as plate spring steel and so on can be used which have an appropriate elasticity (spring quality).

The lower washing nozzle 21 adapted to be fitted onto the lower rinsing nozzle mount 27 in horizontally rotatable manner to be positioned below the lower rinsing nozzle 22 is adapted to rest horizontally rotatably on a lower washing nozzle mount 40 formed concentrically outside the lower rinsing nozzle mount 27. Thus, the lower washing nozzle 21 basically comprises a lower washing nozzle holder 35, which is substantially circular-shaped as viewed from above, and three lower washing nozzle pipes 36, 36, 36 welded to the nozzle holder 35 to be equally spaced from one another in a circumferential direction and extend radially. Also, the lower washing nozzle holder 35 comprises upper and lower collar members 37, 38 and upper and lower holder portions 35*a*, 35*b*.

Figure 3:
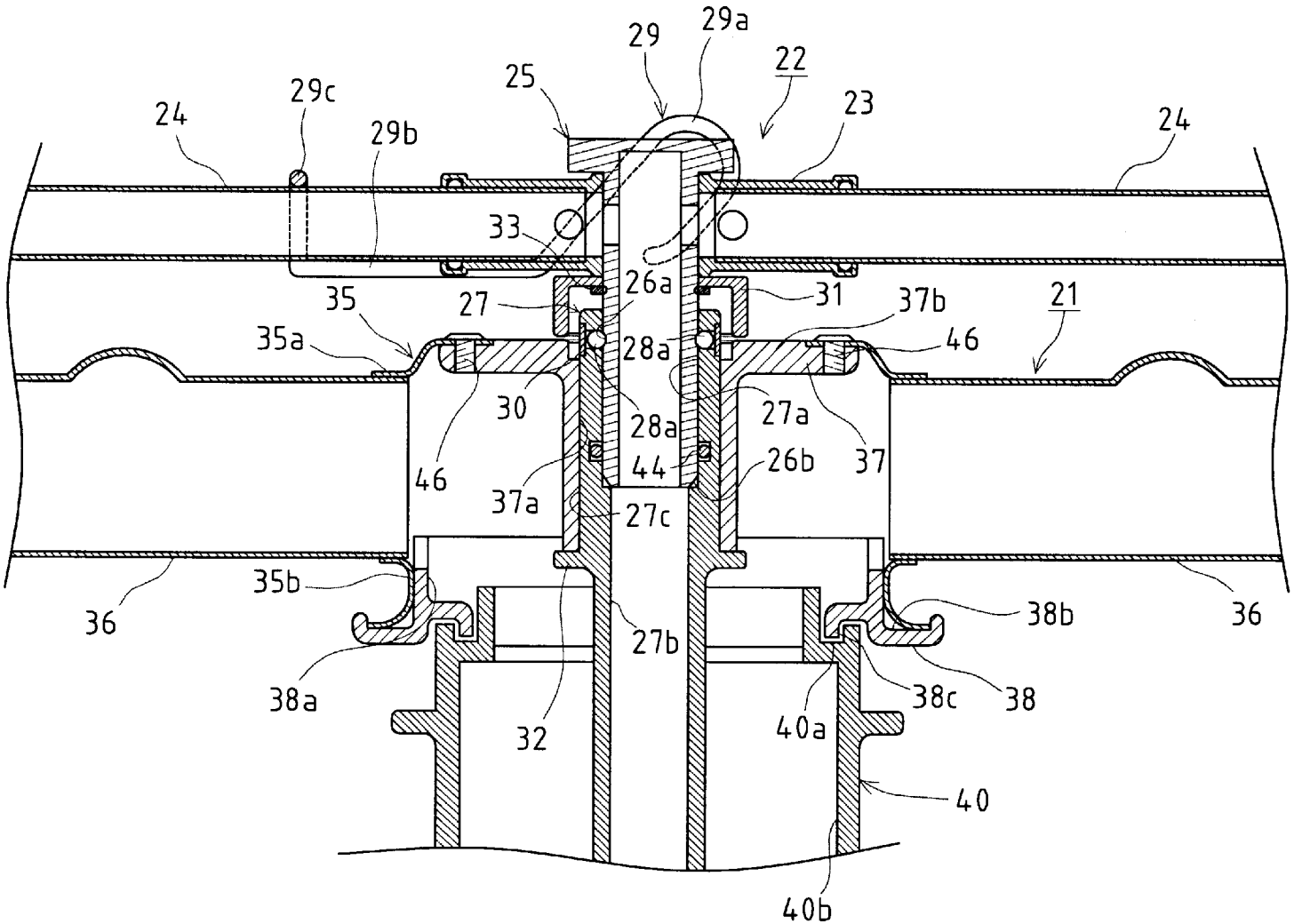
FIG. 3 is a side cross sectional view showing a nozzle structure according to a first embodiment of the present invention.
Figure 4:
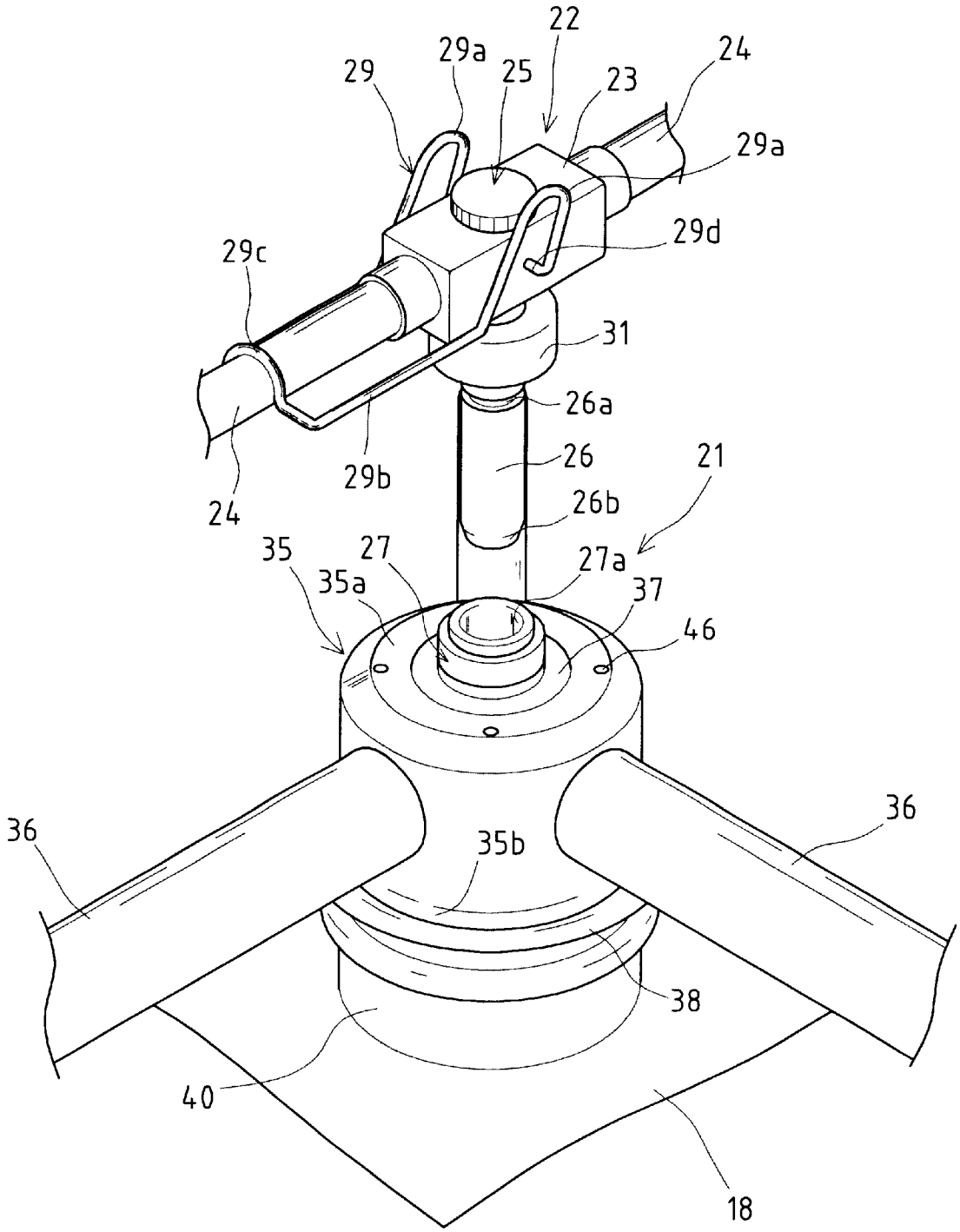
FIG. 4 is a schematic perspective view showing an essential part of the nozzle structure according to the first embodiment.

As shown in FIG. 3, the upper collar member 37 comprises a cylindrical-shaped body formed with a central through hole 37*a*, which permits insertion of the lower rinsing nozzle mount 27 therethrough and is formed at its upper end with a flange 37*b*, the flange 37*b* having a predetermined diameter and having the upper holder portion 35*a* fixed thereto through a plurality of screws 46. A radially extending flange 32 is formed in a predetermined position on the outer wall 27*c* of the lower rinsing nozzle mount 27 to abut against a lower end of the upper collar member 37, which is rotatably fitted onto the lower rinsing nozzle mount 27 through the central through hole 37*a*, thereby positioning the lower washing nozzle 21.

The lower collar member 38 comprises a cylindrical-shaped body formed with a central through hole 38*a* having a larger diameter than that of the lower rinsing nozzle mount 27, and the lower holder portion 35*b* is fixed to an outer periphery of the collar member 38 through a plurality of screws (not shown). In addition, a fitting groove 38*b* is formed around the entire periphery of and outside of the lower collar member 38 so that the lower holder portion 35*b* can be mounted in the fitting groove 38*b* in fitted condition. Further, a support 38*c* is formed over the entire periphery of and inside of the lower collar member 38.

The lower washing nozzle mount 40 is formed concentrically outside the lower rinsing nozzle mount 27 to be cylindrical-shaped, and is formed at its upper end over its entire periphery with a groove 40*a*, in which the support 38*c* of the lower collar member 38 is situated in non-contact condition. A wash water flowing through a central through hole 40*b* in the lower washing nozzle mount 40 is supplied to the respective lower washing nozzle pipes 36 via the central through hole 38*a* in the lower collar member 38. Plastic materials or the like, which are easy to slide and are resistant to high temperatures of washing water, are preferably used as a material for the upper and lower collar members 37, 38.

Provided turnably on the lower rinsing nozzle holder 23 of the lower rinsing nozzle 22 is an operating lever 29 for use in dismounting the lower rinsing nozzle 22 from the lower rinsing nozzle mount 27. The operating lever 29 is constructed such that its turning from a stand-by position to an operating position enables dismounting the lower rinsing nozzle 22 from the lower rinsing nozzle mount 27. The operating lever 29 is formed by bending a rod material having a circular-shaped cross section, and comprises pivots 29*d*, 29*d* turnably pivoted centrally of the length of and on the both side surfaces of the lower rinsing nozzle holder 23, semicircular-shaped acting portions 29*a*, 29*a* provided contiguous to the pivots 29*d*, 29*d* and adapted to project upward from the lower rinsing nozzle holder 23 in the stand-by position and project downward from the lower rinsing nozzle holder 23 in the operating position, operating portions 29*b*, 29*b* provided contiguous to the acting portions 29*a*, 29*a* and adapted to extend in parallel with one of the lower nozzle pipes 24 interposed therebetween in the stand-by position, and a semicircular-shaped abutting portion 29*c* connecting ends of the both operating portions 29*b*, 29*b* and capable of abutting against the lower nozzle pipe 24 from above.

In a state, in which the lower rinsing nozzle 22 is mounted on the lower rinsing nozzle mount 27, the operating lever 29 placed in the stand-by position is turned toward the operating position, and then the acting portions 29*a*, 29*a* are caused to abut against the upper end of the lower washing nozzle 21 to thereby push the lower rinsing nozzle shaft 25 upward in a direction, in which the lower rinsing nozzle shaft 25 is pulled out of the mount hole 27*a*, thereby removing the lower rinsing nozzle 22.

(Function of First Embodiment)

Figure 6:
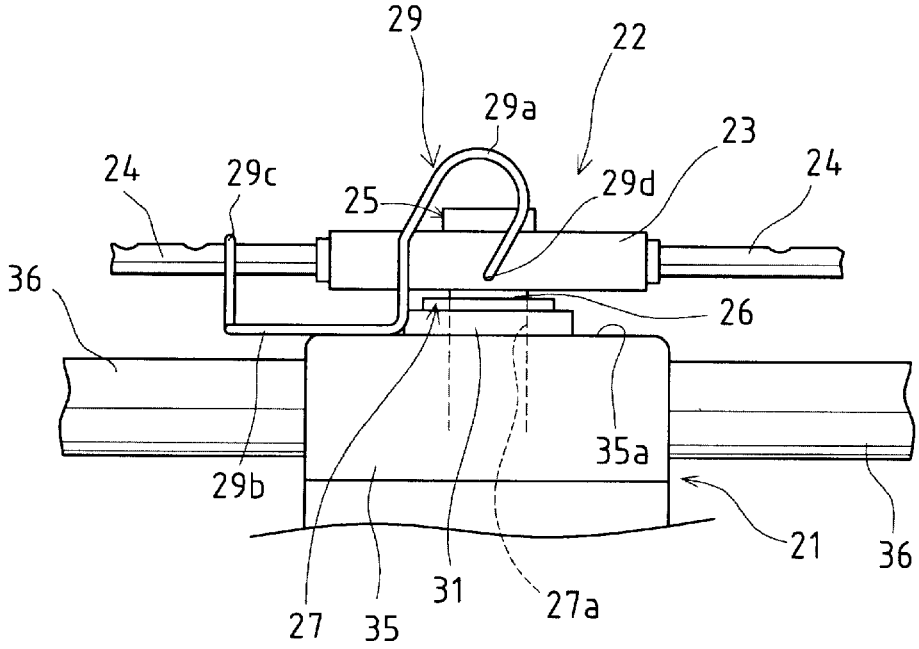
FIG. 6 is a view illustrating the step of dismounting the lower rinsing nozzle mount in the first embodiment.
Figure 7:
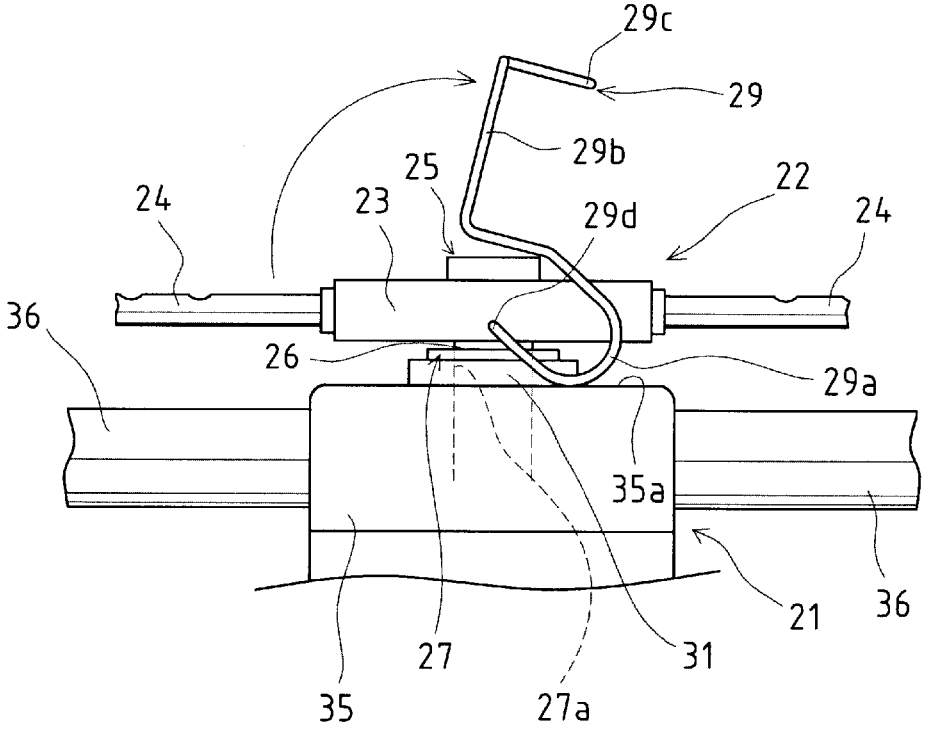
FIG. 7 is a view illustrating the step of dismounting the lower rinsing nozzle mount in the first embodiment.
Figure 8:
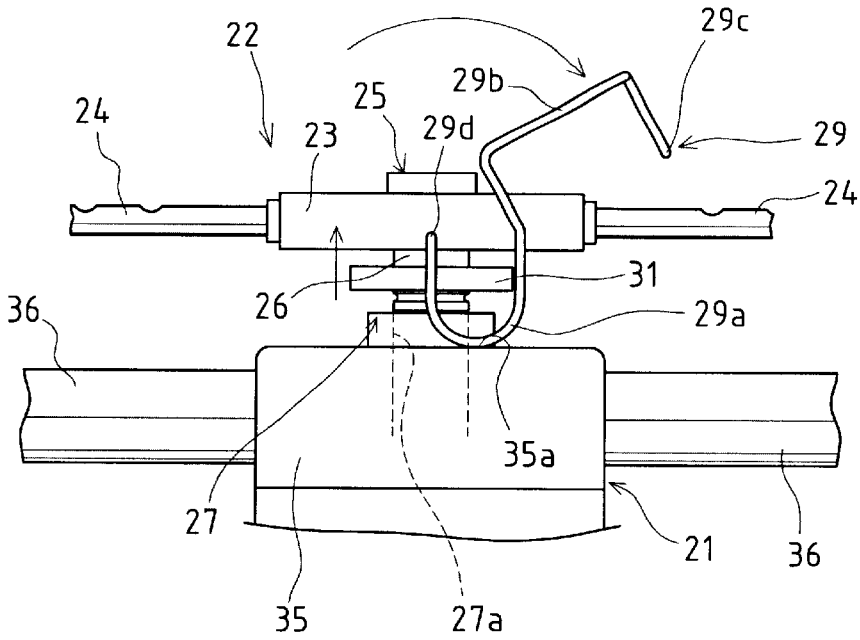
FIG. 8 is a view illustrating the step of dismounting the lower rinsing nozzle mount in the first embodiment.
Figure 9:
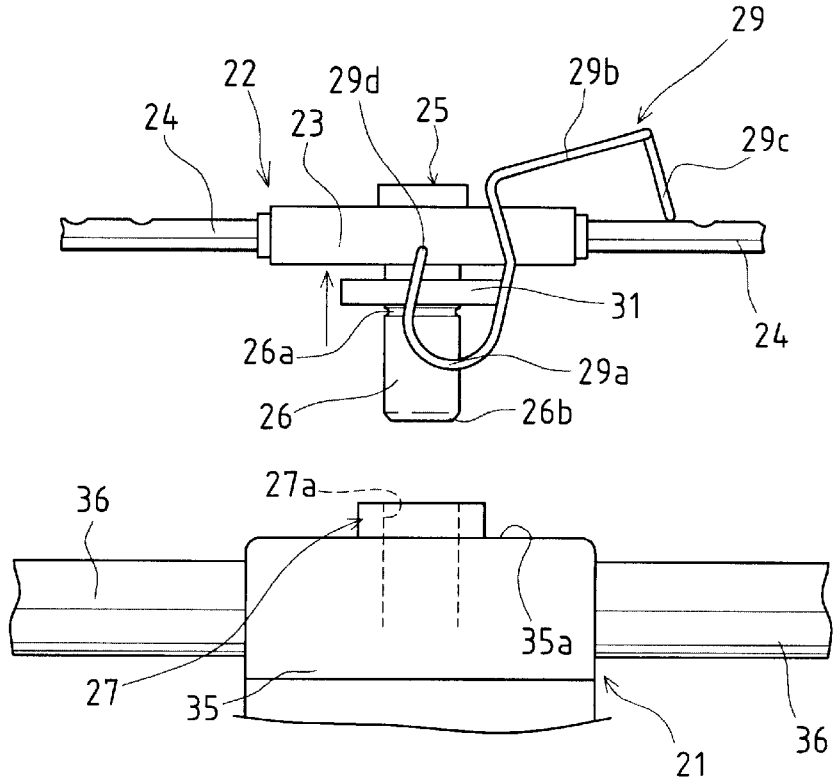
FIG. 9 is a view illustrating the step of dismounting the lower rinsing nozzle mount in the first embodiment.

Next, the nozzle structure for a dish washer, according to the first embodiment will be described with respect to its action. When the lower rinsing nozzle 22 mounted on the lower rinsing nozzle mount 27 is to be removed as shown in FIG. 6, the operating lever 29 placed in the stand-by position where the abutting portion 29*c* abuts against the lower nozzle pipe 24 is turned in a clockwise direction shown in the drawing. Therefore, the acting portions 29*a* on the operating lever 29 are caused to abut against the upper holder portion 35*a*, which defines an upper surface of the lower washing nozzle holder 35, as shown in FIG. 7. When the operating lever 29 is further turned in the clockwise direction, the acting portions 29*a* continue to turn sliding on the upper holder portion 35*a* (see FIG. 8). With a series of these actions, the turning movement of the operating lever 29 in the clockwise direction is converted into forces for pushing the lower rinsing nozzle holder 23 upward, by which forces the fitting portion 26 of the lower rinsing nozzle shaft 25 is simply pulled out of the mount hole 27*a* (see FIG. 9).

More specifically, the latch balls 28*a* on the second fitting portion 28 of the lower rinsing nozzle mount 27 are pushed over the outer surface of the fitting portion 26 due to the fitting portion 26 being pulled upward to retreat from the latch holes 28*b* against the bias of the elastic ring 30, so that the balls are released from the fitting condition associated with the fitting groove 26*a*. Therefore, the fitting portion 26 is allowed to separate from the mount hole 27*a*. When the fitting portion 26 passes a position where the latch balls 28*a* are arranged, the latch balls 28*a* are caused by the elastic force of the elastic ring 30 to project inward from the latch holes 28*b*.

The lower rinsing nozzle 22 can be removed simply with a small magnitude of force since the principle of lever is made use of with the operating lever 29, in which the acting portions 29*a* serve as points of application, the pivots 29*d* on the lower rinsing nozzle holder 23 serve as fulcrums, and the operating portions 29*b* serve as points of force. Incidentally, the acting portions 29*a* of the operating lever 29 abuts against the upper collar member 37 whereby the force, by which the lower rinsing nozzle 22 is removed from the lower rinsing nozzle mount 27, is obtained, and a great force applied at this time is accommodated by the slippery upper collar member 37. Such accommodation of the force eliminates any damage against the upper collar member 37 to achieve a smooth separating operation.

Although the lower rinsing nozzle 22 becomes hot immediately after rinsing with hot water, the operating lever 29 is thin and the operating portions 29*b* are spaced from the lower rinsing nozzle pipes 24, through which high temperature water flows, so that the lever is cooled in a short time to be capable of being operated before the lapse of time. Incidentally, if the operating lever 29 is turned by having a suitable tool such as a rod or the like caught on the operating portions 29*b* of the operating lever 29, which is spaced away from the lower rinsing nozzle pipes 24, the lever can be operated even when it is in a high temperature condition.

After the lower rinsing nozzle 22 is removed from the lower rinsing nozzle mount 27, the lower washing nozzle 21 can be dismounted from the lower rinsing nozzle mount 27 and the lower washing nozzle mount 40 only by pulling the lower washing nozzle 21 up. Therefore, it is possible to carry out cleaning, inspection or repair or the like for the lower rinsing nozzle 22 and the lower washing nozzle 21 with ease in a short time thereby to keep the both nozzles 22, 21 sanitary at all times.

When the lower rinsing nozzle 22 and the lower washing nozzle 21 are to be mounted on the corresponding mounts 27, 40, the central through hole 37*a* of the upper collar member 37 in the lower washing nozzle 21 first permits the lower rinsing nozzle mount 27 to be inserted therethrough to cause the lower end of the upper collar member 37 abutting against the flange 32. At this time, the support 38*c* of the lower collar member 38 is situated in the groove 40*a* of the lower washing nozzle mount 40 in non-contact manner, so that the lower washing nozzle 21 is horizontally rotatably mounted on the mount 40. Also, in this state, the central through hole 40*b* in the lower washing nozzle mount 40 is made in communication with the respective lower washing nozzle pipes 36, so that washing water flowing through the central through hole 40*b* can be supplied to the respective lower washing nozzle pipes 36.

Figure 10:
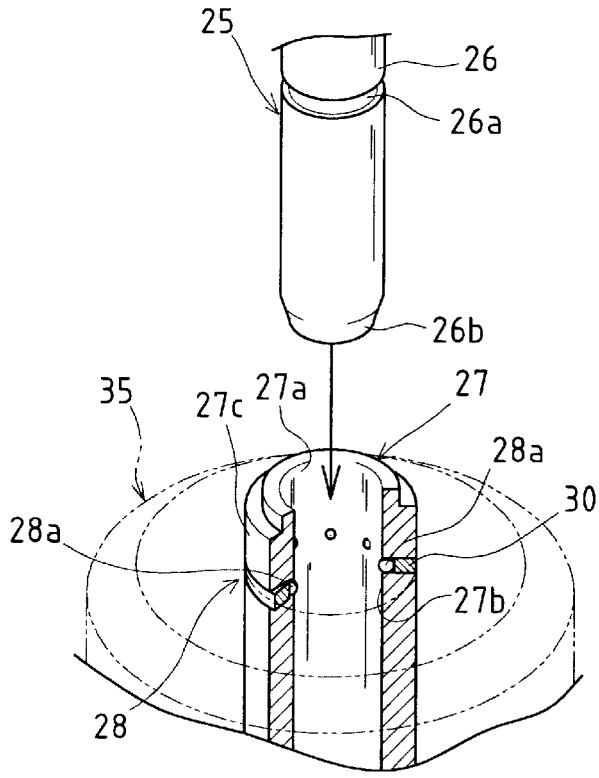
FIG. 10 is a view illustrating the step of mounting the lower rinsing nozzle mount in the first embodiment.

Then, in a state, in which the operating lever 29 is returned to the stand-by position (position shown in FIG. 6), the fitting portion 26 on the lower rinsing nozzle shaft 25 is inserted into the mount hole 27*a* in the lower rinsing nozzle mount 27. In this case, an outer diameter of the fitting portion 26 is almost the same as an inner diameter of the mount hole 27*a* to provide no gap therebetween, but the fitting portion 26 can be easily inserted into the mount hole 27*a* without strictly ascertaining a positional relationship because the fitting portion 26 is formed at the lower end thereof with the tapered portion 26*b* as shown in FIG. 10.

Figure 11:
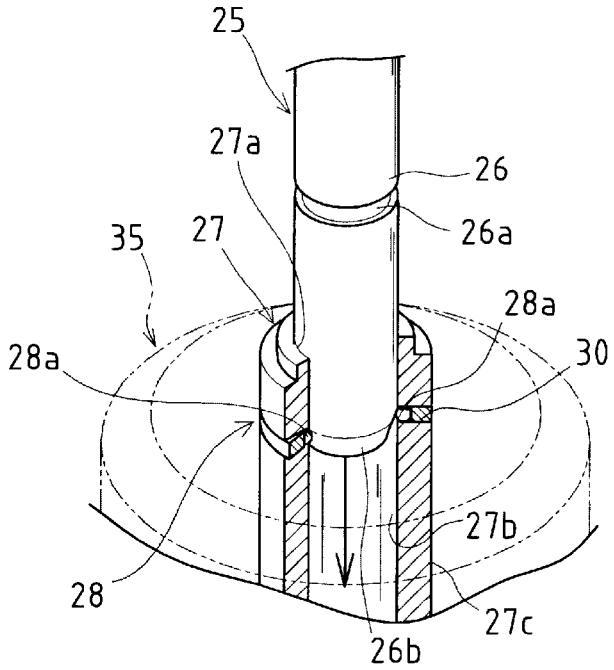
FIG. 11 is a view illustrating the step of mounting the lower rinsing nozzle mount in the first embodiment.
Figure 12:
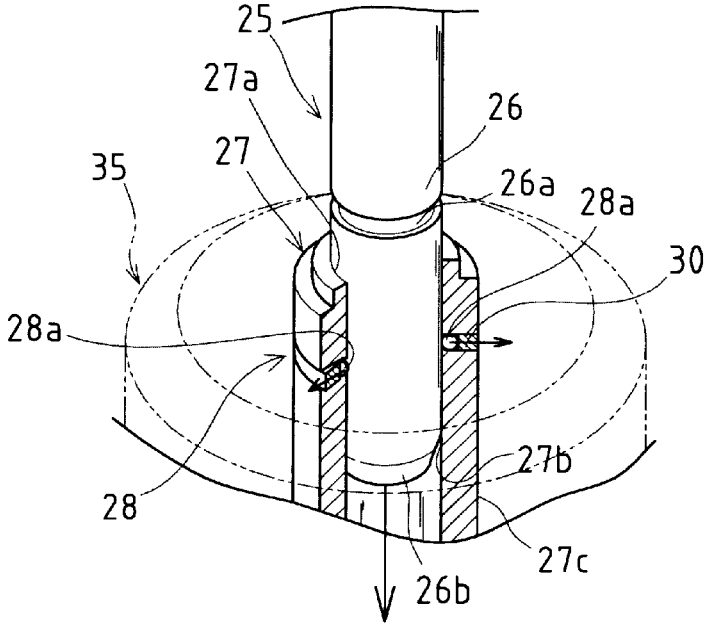
FIG. 12 is a view illustrating the step of mounting the lower rinsing nozzle mount in the first embodiment.

When such insertion of the fitting portion 26 continues, the tapered portion 26*b* will abut against the eight latch balls 28*a* in total which project from the inner wall 27*b* through the latch holes 28*b* as shown in FIG. 11. When the fitting portion 26 is further inserted from that state, a downward force produced by such insertion is efficiently converted by the tapered portion 26*b* into an outward force about the fitting portion 26, so that the respective latch balls 28*a* are pushed toward an outer peripheral side of the ball installation section 28*c* against the bias of the elastic ring 30 (see FIG. 12). Therefore, any projection for interfering with the insertion of the fitting portion 26 disappears inside the inner wall 27*b*, so that insertion of the fitting portion 26 can be made smooth.

Figure 13:
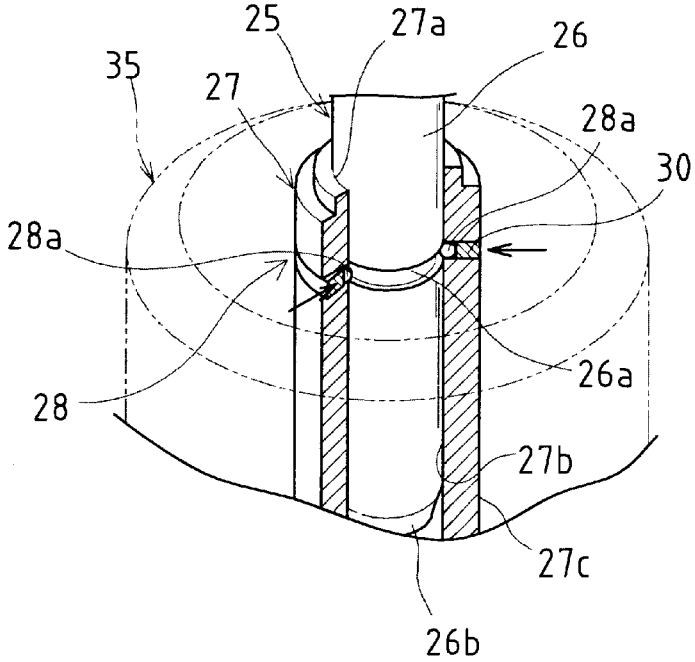
FIG. 13 is a view illustrating the step of mounting the lower rinsing nozzle mount in the first embodiment.

When the fitting groove 26*a* in the fitting portion 26 comes to the same level as that, at which the latch balls 28*a* are arranged, the latch balls 28*a* constantly biased inward by the elastic ring 30 is made to project from the inner wall 27*b* as shown in FIG. 13 to be fitted into the fitting groove 26*a*. Thus, the lower rinsing nozzle 22 is made to be mounted on the lower rinsing nozzle mount 27 in positioning manner. Also, the O-ring 44 arranged on the lower rinsing nozzle mount 27 is made to abut closely against an outer peripheral surface of the lower rinsing nozzle 22, thereby preventing leakage of water and the lower rinsing nozzle shaft 25 from coming off the mount 27 with ease.

Still more, the mount hole 27*a* in the lower rinsing nozzle mount 27 comes in communication with the respective lower rinsing nozzle pipes 24 (see FIG. 3), so that rinsing water flowing through the mount hole 27*a* can be fed to the respective lower rinsing nozzle pipes 24. Also, the thrust washer 31 fitted onto the fitting portion 26 comes close to and above the lower washing nozzle holder 35 on the lower washing nozzle 21 to restrain upward movements of the lower washing nozzle 21.

In this manner, because the work for dismounting and mounting of the lower rinsing nozzle 22 can be carried out simply in a short time, inspection, cleaning and the like for the nozzle 22 become easy. In addition, the lower rinsing nozzle 22 in the first embodiment is made lightweight in proportion to no need of any mount bolts, as compared with the prior art, in which such lower rinsing nozzle 22 is detachably secured by means of bolts or the like.

Besides, while an explanation has been given to the first embodiment, in which the coming-off preventing means in the form of a ball-latch structure and the coming-off preventing means comprising an O-ring are used in combination, coming-off prevention can be attained for the lower rinsing nozzle even if either of the above means is used independently. In addition, while an explanation has been given to the first embodiment, in which the fitting groove is formed as a first fitting means in the fitting portion of the lower rinsing nozzle and a second fitting means composed of the latch balls is provided in the mount hole of the lower rinsing nozzle mount, such arrangement of the both fitting means may be replaced by that arrangement, in which a first fitting means composed of the latch balls is provided in the fitting portion of the lower rinsing nozzle and a fitting groove is formed as a second fitting means in the mount hole of the lower rinsing nozzle.

(Second Embodiment)

Figure 14:
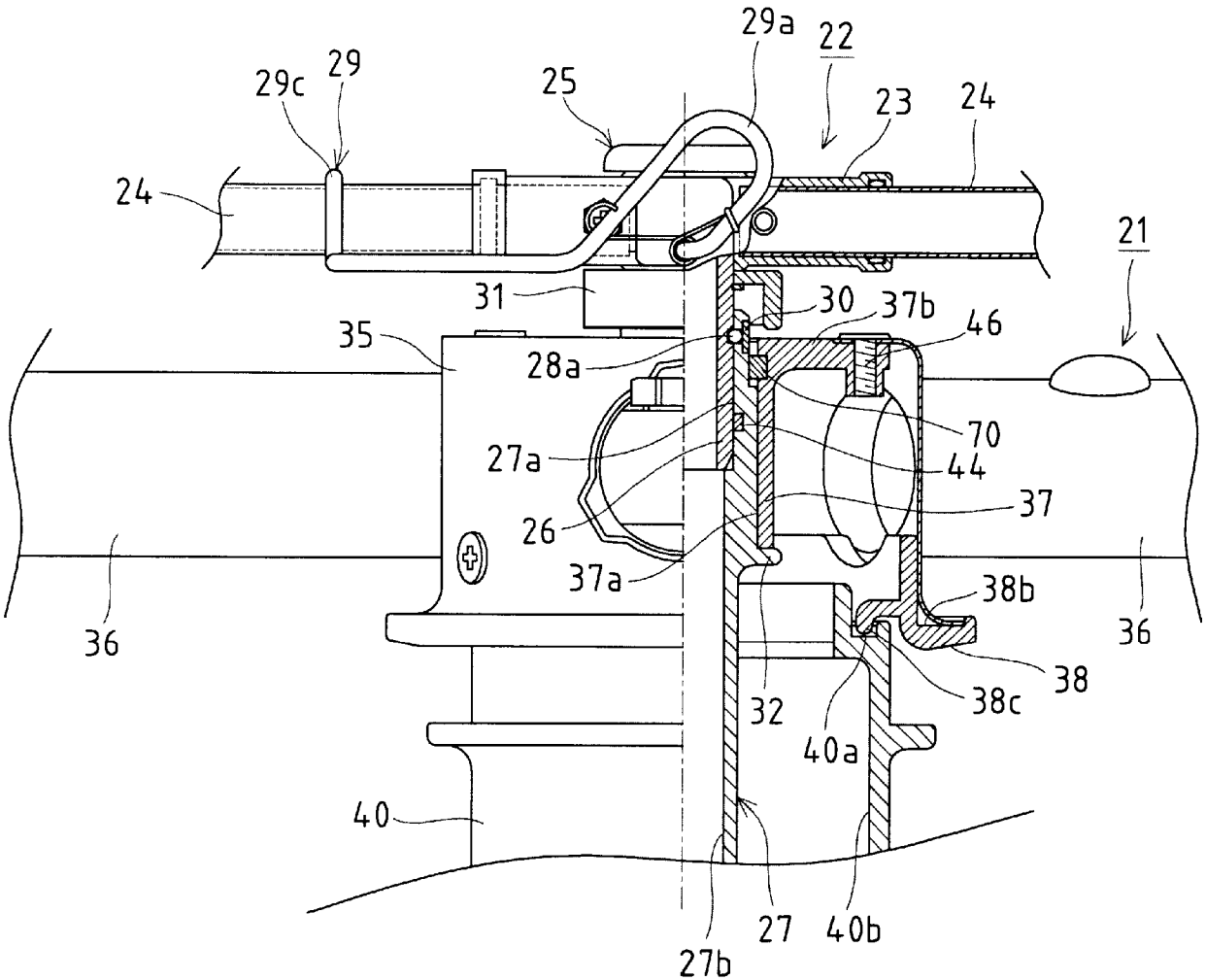
FIG. 14 is a side view showing in partial cross section a nozzle structure according to a second embodiment of the present invention.
Figure 15:
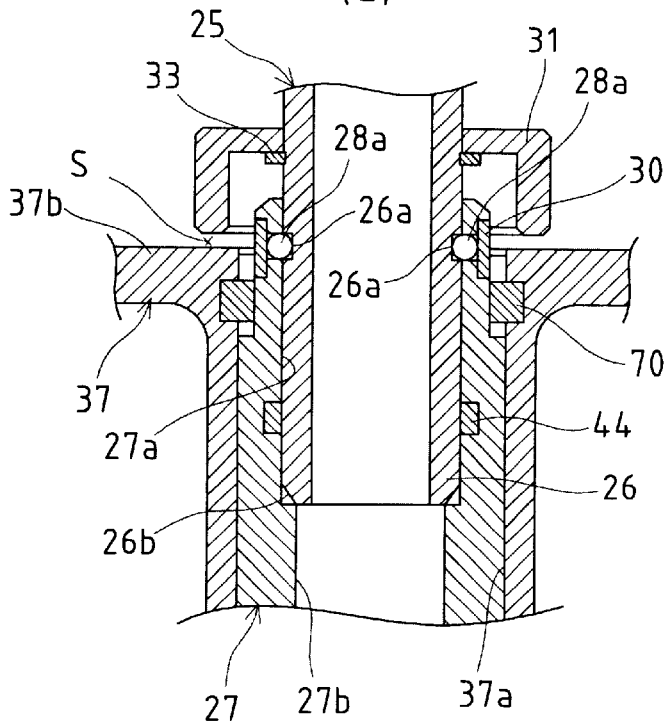
FIGS. 15A and 15B are views illustrating an action of the nozzle structure according to the second embodiment.
Figure 15:
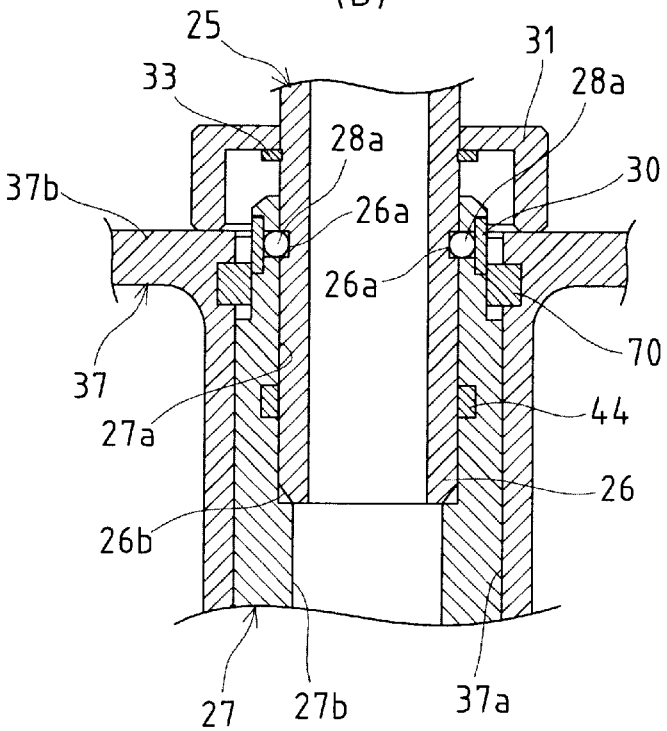

FIGS. 14, 15A and 15B show a nozzle structure according to a second embodiment, which is the same as the first embodiment in basic constitution, and an explanation will be given to portions of the second embodiment, which are different from those in the first embodiments. A predetermined gap S is defined between a top surface of the upper collar member 37 in the lower washing nozzle 21 and an underside of the thrust washer 31 in the lower rinsing nozzle 22 in a state, in which the lower washing nozzle 21 and the lower rinsing nozzle 22 are mounted on the lower rinsing nozzle mount 27, and the lower washing nozzle 21 is made movable a distance corresponding to the gap S. Further, arranged in the central through hole 37*a* of the upper collar member 37 on the lower washing nozzle 21 is a ring-shaped restraint member 70 capable of restraining outward deformation of the elastic ring 30 in the second fitting portion 28.

Thus, in a state, in which the lower end of the upper collar member 37 on the lower washing nozzle 21 abuts against the flange 32, the restraint member 70 is situated in a withdrawal position (FIG. 15A), where it is spaced downward from the outside of the elastic ring 30, to allow outward deformation of the elastic ring 30. Further, washing water is supplied to the lower washing nozzle 21 during the washing operation, and pressures of washing water supplied push the lower washing nozzle 21 to a position where the nozzle abuts against the thrust washer 31, so that the restraint member 70 comes to a restraint position (FIG. 15B) outside of the elastic ring 30 to restrain outward deformation of the elastic ring 30 in such state.

With the above nozzle structure according to the second embodiment, when washing water is supplied to the lower washing nozzle 21 during the washing operation in a state, in which the lower rinsing nozzle 22 is mounted on the lower rinsing nozzle mount 27 by means of the ball-latch structure and the coming-offpreventing means such as the O-ring 44 or the like, pressures of washing water supplied cause the lower washing nozzle 21 to rise a distance corresponding to the gap S as shown in FIG. 15B to have the upper collar member 37 abutting against the thrust washer 31. At this time, the restraint member 70 provided on the upper collar member 37 is situated in the restraint position outside of the elastic ring 30 to thereby restrain outward deformation of the elastic ring 30. Thus, outward movements of the latch balls 28*a* are restrained by the elastic ring 30 and the restraint member 70 even if any forces tending to push the lower rinsing nozzle 22 upward are applied during the washing operation, so that the fitting relationship between the latch balls 28*a* and the corresponding fitting groove 26*a* is not released and the lower rinsing nozzle 22 is assuredly prevented from coming off during the operation.

In addition, the lower washing nozzle 21 descends by its own weight when supplying of washing water to the nozzle 21 is stopped, and the restraint member 70 comes to the withdrawal position where it is spaced downward from the outside of the elastic ring 30 as shown in FIG. 15A. Therefore, if the operating lever 29 is operated to push the lower rinsing nozzle holder 23 upward in the manner described above, pulling-up of the fitting portion 26 causes the latch balls 28*a* in the second fitting portion 28 on the lower rinsing nozzle mount 27 to be pushed over the outer surface of the fitting portion 26 to retreat from the latch holes 28*b* against the bias of the elastic ring 30 to be released from the fitting condition associated with the fitting groove 26*a*. Therefore, the fitting portion 26 is allowed to separate from the mount hole 27*a*.

(Third Embodiment)

Figure 16:
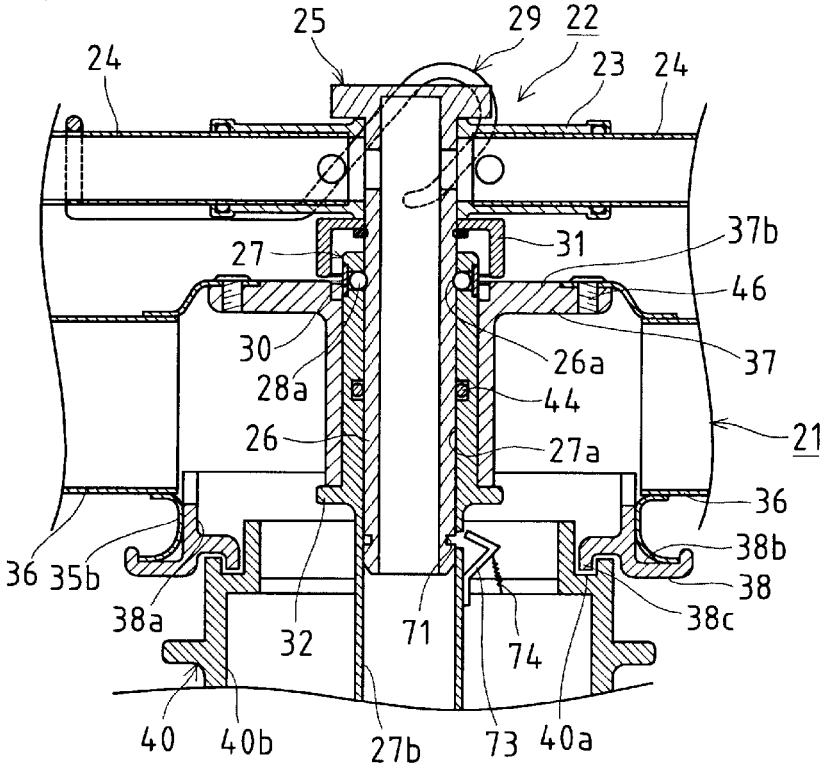
FIG. 16 is a side cross sectional view showing in a non-engaging state engaging members of a nozzle structure according to a third embodiment of the present invention.
Figure 17:
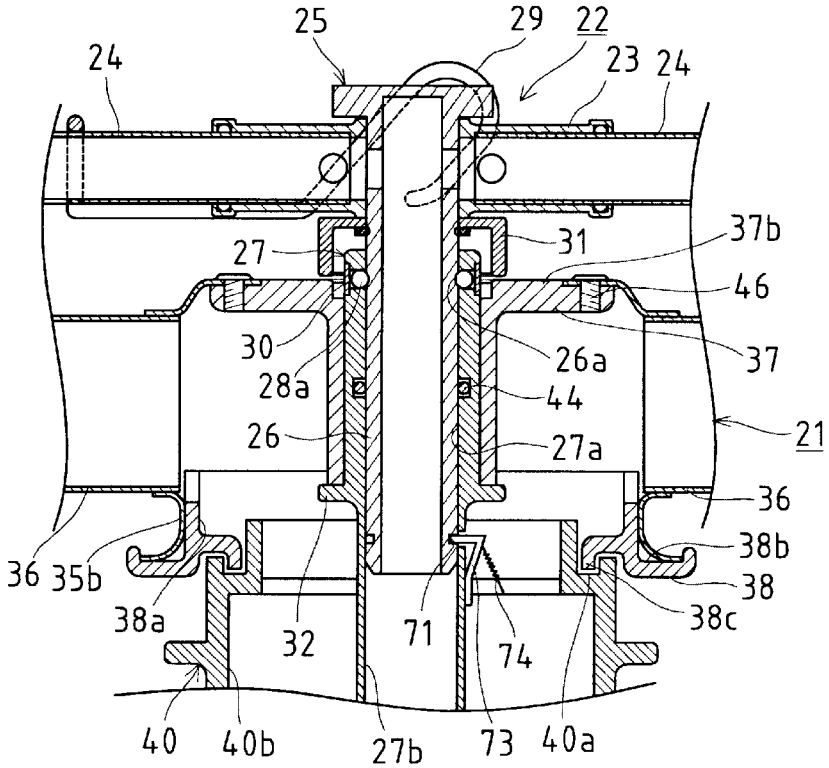
FIG. 17 is a side cross sectional view showing in a engaging state the engaging members of the nozzle structure according to the third embodiment.

FIGS. 16 and 17 show a nozzle structure according to a third embodiment, which is the same as the first embodiment in basic constitution, and an explanation will be given to portions in the third embodiment, which are different from those in the first embodiment. When inserted into the mount hole 27*a* of the lower rinsing nozzle mount 27, the lower rinsing nozzle shaft 25 positions its lower end below a level, at which the flange 32 is formed, and is provided at its outer peripheral surface near the lower end thereof with an engaged portion 71. Meanwhile, the lower rinsing nozzle mount 27 is formed with a diametrically extending through hole 72 which is positioned corresponding to the engaged portion 71.

Further, the outer surface of the lower rinsing nozzle mount 27 facing the central through hole 40*b* of the lower washing nozzle mount 40, through which washing water flows, is provided with an engaging member 73 which is engagable with the engaged portion 71 through the through hole 72. The engaging member 73 is constructed to be ordinarily situated in a non-engagement position (FIG. 16) where it is spaced away from the engaged portion 71 by a tension spring 74. And the engaging member 73 is set to shift to an engagement position (FIG. 17), where it engages with the engaged portion 71, against the bias of the tension spring 74 under the influence of pressures of washing water supplied to the lower washing nozzle 21 during the washing operation.

With the above nozzle structure according to the third embodiment, when washing water is supplied to the lower washing nozzle 21 during the washing operation in a state, in which the lower rinsing nozzle 22 is mounted on the lower rinsing nozzle mount 27 by means of the ball-latch structure and the coming-off preventing means such as the O-ring 44 or the like, the engaging member 73 is acted by pressures of washing water supplied to be displaced to the engagement position, where it engages with the engaged portion 71, against the bias of the tension spring 74 as shown in FIG. 17. Thus, even if any forces tending to push the lower rinsing nozzle 22 upward are applied during the washing operation, the engaging member 73 on the lower rinsing nozzle mount 27 engages with the engaged portion 71 on the lower rinsing nozzle shaft 25 to restrain upward movements of the lower rinsing nozzle 22, so that the lower rinsing nozzle 22 is assuredly prevented from coming off during the operation.

In addition, when supplying of washing water to the lower washing nozzle 21 is stopped, the engaging member 73 is displaced to the non-engagement position, where it is spaced away from the engaged portion 71, by the elasticity of the tension spring 74 as shown in FIG. 16. Therefore, if the operating lever 29 is operated to push the lower rinsing nozzle holder 23 upward in the manner described above, the lower rinsing nozzle 22 is separated from the lower rinsing nozzle mount 27.

Be noted that the ball-latch structure and the coming-off preventing means comprising an O-ring may be omitted in the third embodiment, and only a coming-off preventing means comprising the engaged portion and the engaging member may be employed. In addition, while an explanation has been given to the third embodiment, in which the engaging member is displaced between the non-engagement position and the engagement position by the tension spring and pressures of washing water supplied, the engaging member may be formed from a shape memory alloy to be displaced between the non-engagement position and the engagement position depending upon temperatures of washing water.

For example, the situation can be coped with by subjecting the engaging member to the shape memory treatment such that the engaging member is situated in the engagement position, where it engages with the engaged portion on the lower rinsing nozzle shaft 25, when the engaging member disposed in the non-engagement position at room temperature is exposed to washing water to be heated to a required temperature. In this case, the tension spring can be omitted for a more simplified structure.

(Fourth Embodiment)

Figure 18:
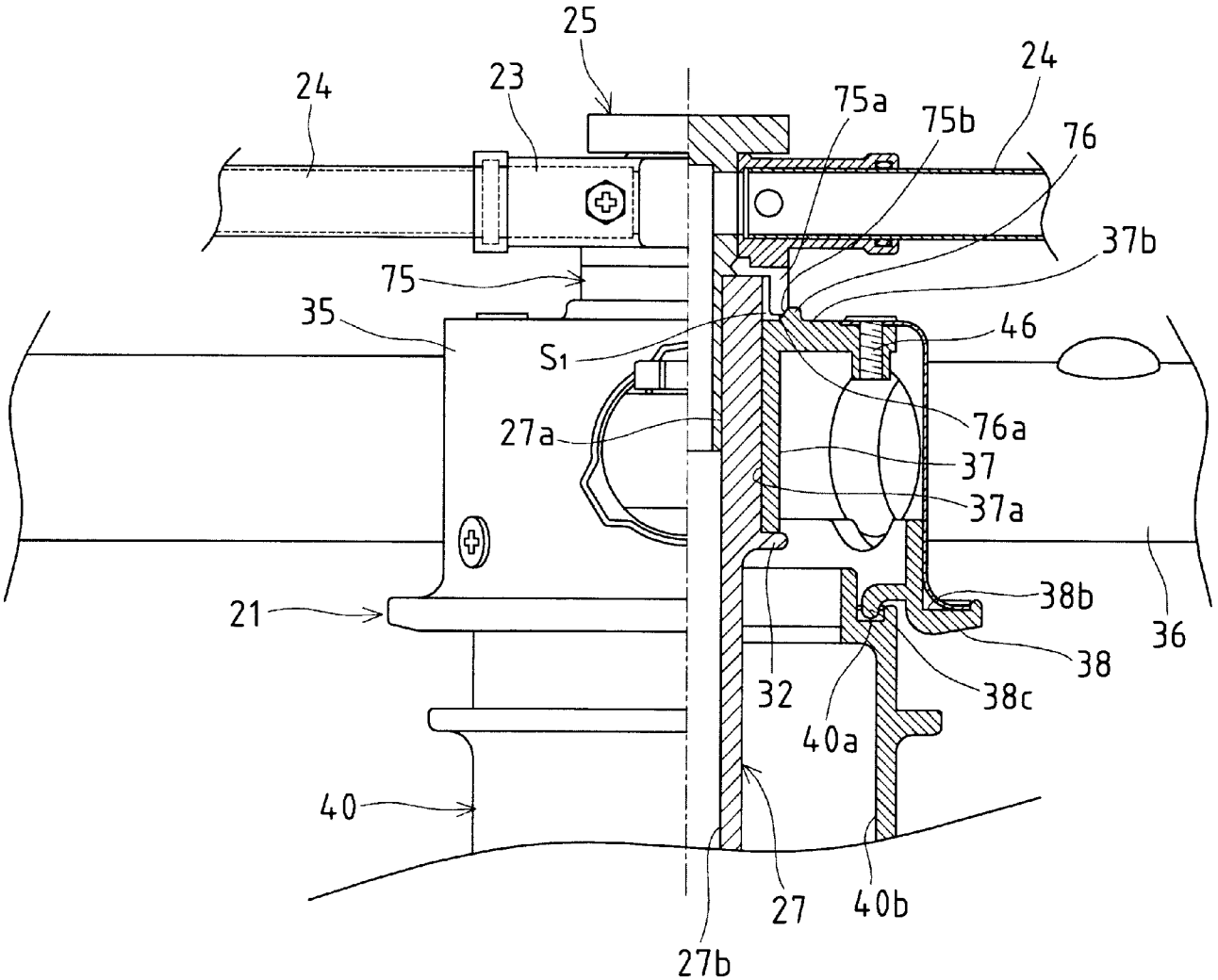
FIG. 18 is a side view showing in partial cross section a nozzle structure according to a fourth embodiment of the present invention.

FIG. 18 shows a nozzle structure according to a fourth embodiment, which is the same as the first embodiment in basic constitution, and an explanation will be given to portions in the fourth embodiment, which are different from those in the first embodiment. Provided integrally on the underside of the lower rinsing nozzle shaft holder 23 is a restraint member 75 serving as a ring-shaped coming-off preventing means which covers an upper end of the lower rinsing nozzle mount 27. The restraint member 75 is formed at one location in a circumferential direction with a notch 75*a* to be capable of decreasing in diameter in a diametrical direction, and is also formed at an outer peripheral edge of the lower end thereof with a tapered surface 75*b* which is inclined inwardly downwardly. Also, provided on the upper surface of the upper collar member 37 on the lower washing nozzle 21 is a ring-shaped pressure contact member 76 which serves as a coming-off preventing means facing an outside of the restraint member 75, and a tapered surface 76*a* is formed at an inner periphery of the collar member to match with the tapered surface 75*b* on the restraint member 75.

A predetermined gap S 1 is defined between a top surface of the upper collar member 37 in the lower washing nozzle 21 and a lower end of the restraint member 75 in the lower rinsing nozzle 22 in a state, in which the lower washing nozzle 21 and the lower rinsing nozzle 22 are mounted on the lower rinsing nozzle mount 27, and the lower washing nozzle 21 is made upwardly movable a distance corresponding to the gap S 1.

Thus, in a state, in which the lower end of the upper collar member 37 on the lower washing nozzle 21 abuts against the flange 32, the tapered surface 76*a* on the pressure contact member 76 is situated in a non-pressure contact position where it is not in pressure contact with the tapered surface 75*b* on the restraint member 75, and in such state the restraint member 75 is not reduced in diameter. Further, when washing water is supplied to the lower washing nozzle 21 during the washing operation and pressures of washing water supplied push the lower washing nozzle 21 upward, the pressure contact member 76 is made to rise to a pressure contact position, so that the tapered surface 76*a* on the pressure contact member 76 and the tapered surface 75*b* on the restraint member 75 cooperate with each other to provide a tapering action to reduce the restraint member 75 in diameter correspondingly to the notch 75*a* and an inner peripheral surface of the restraint member 75 is brought into pressure contact with an outer peripheral surface of the lower rinsing nozzle mount 27.

With the above nozzle structure according to the fourth embodiment, the fitting portion 26 on the lower rinsing nozzle shaft 25 in the lower rinsing nozzle 22 is fitted into the mount hole 27*a* in the lower rinsing nozzle mount 27 without the use of any ball-latch structure and any coming-off preventing means such as O-rings or the like. At this time, a desired gap S 1 is defined between the top surface of the upper collar member 37 in the lower washing nozzle 21 and the lower end of the restraint member 75 in the lower rinsing nozzle 22, and the inner peripheral surface of the restraint member 75 is brought into non-pressure contact with an outer peripheral surface of the lower rinsing nozzle mount 27.

When washing water is supplied to the lower washing nozzle 21 during the washing operation in this state, pressures of washing water supplied push the lower washing nozzle 21 upward correspondingly to the gap S 1 to have the pressure contact member 76 moving to the pressure contact position from the non-pressure contact position to bring the tapered surface 76*a* into pressure contact with the tapered surface 75*b* on the restraint member 75. Therefore, the restraint member 75 is reduced in diameter correspondingly to the notch 75*a* and the inner peripheral surface of the restraint member is brought into pressure contact with the outer peripheral surface of the lower rinsing nozzle mount 27. Thus, even if any forces tending to push the lower rinsing nozzle 22 upward are applied during the washing operation, the lower rinsing nozzle 22 is prevented from easily coming off during the operation because the restraint member 75 is in pressure contact with the lower rinsing nozzle mount 27.

In addition, the lower washing nozzle 21 descends by its own weight when supplying of washing water to the nozzle 21 is stopped, and the pressure contact member 76 moves to the non-pressure contact position from the pressure contact position. Therefore, if the operating lever 29 (not shown in FIG. 18) is operated to push the lower rinsing nozzle holder 23 upward in the manner described above, the lower rinsing nozzle 22 can be simply dismounted from the lower rinsing nozzle mount 27. The ball-latch structure and the coming-off preventing means such as O-rings or the like may be used in combination in the fourth embodiment.

(Fifth Embodiment)

Figure 19:
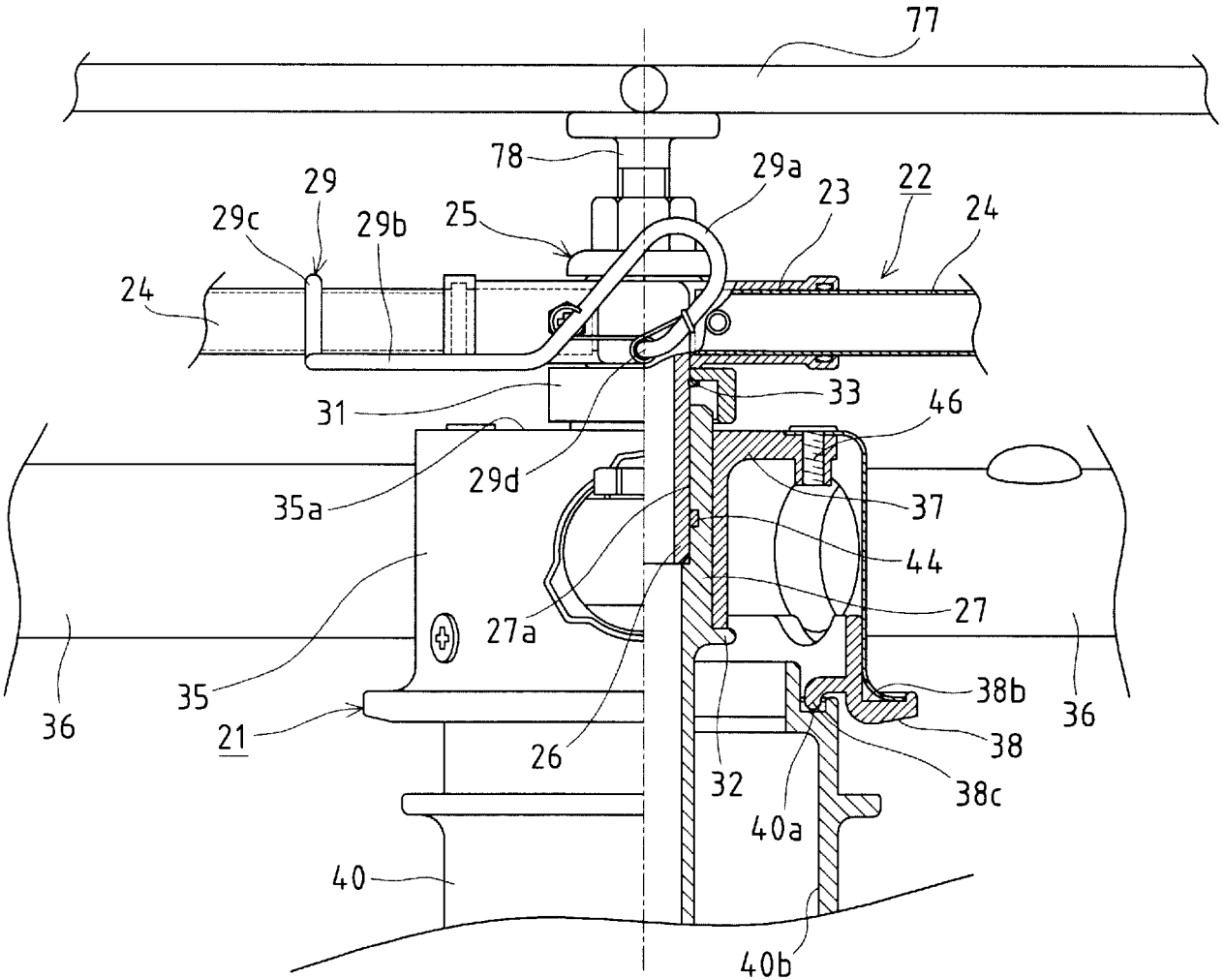
FIG. 19 is a partially side cross sectional view showing in a engaging state a rack rail in a nozzle structure according to a fifth embodiment of the present invention.
Figure 20:
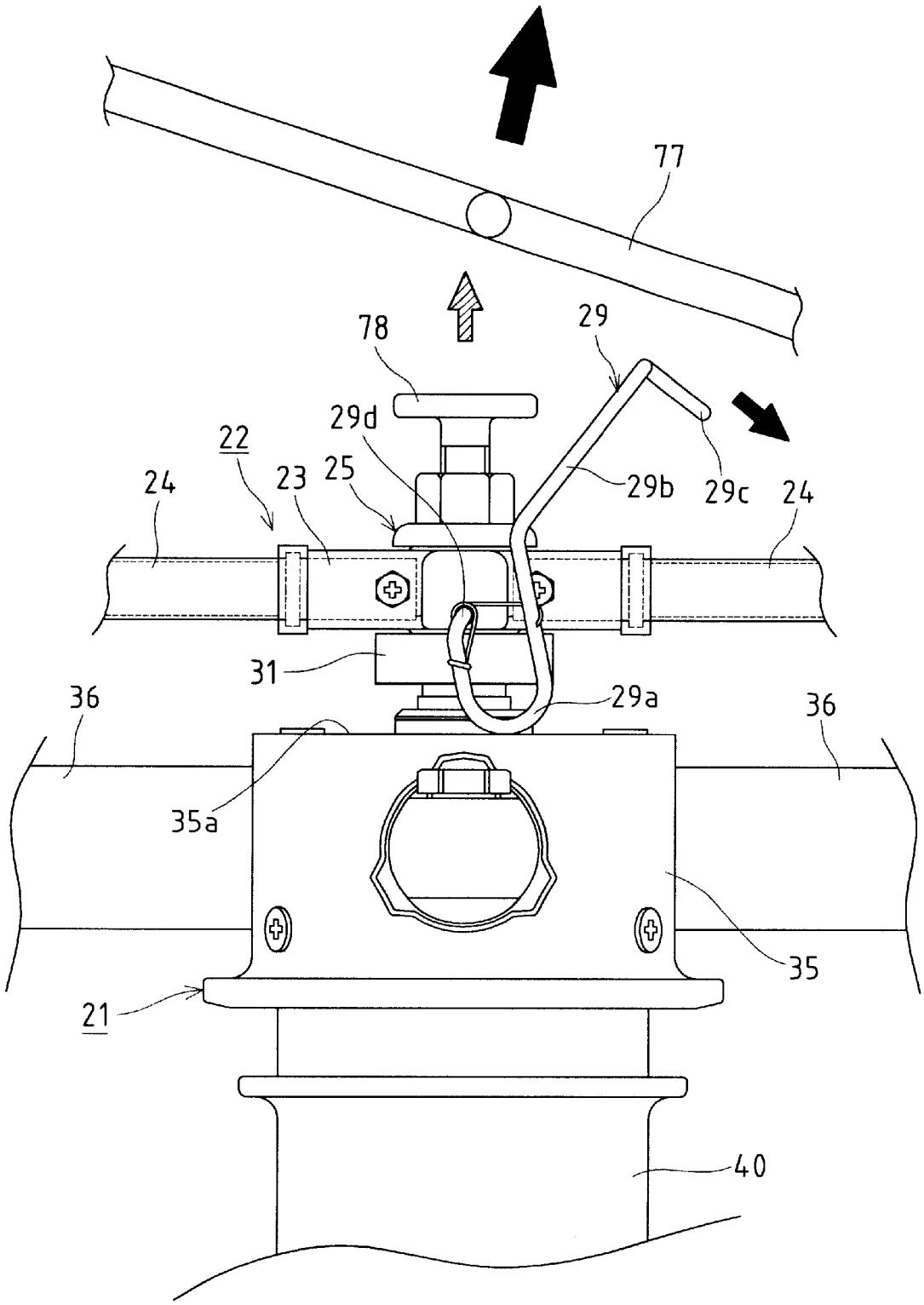
FIG. 20 is a side view showing in a non-engaging state the rack rail in the nozzle structure according to the fifth embodiment.
Figure 21:
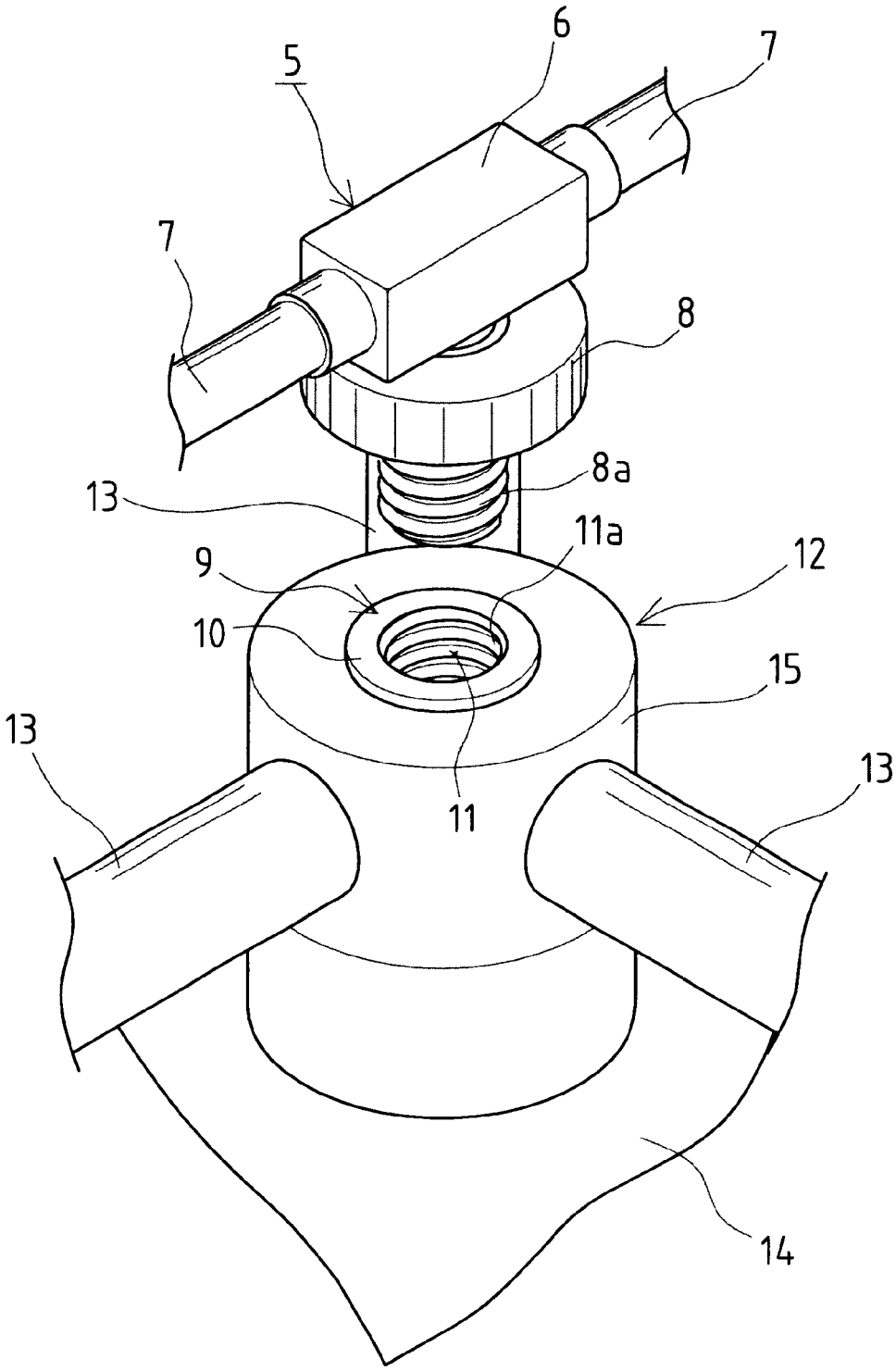
FIG. 21 is a schematic perspective view showing an essential part of a prior nozzle structure.

FIGS. 19 and 20 show a nozzle structure according to a fifth embodiment, which is the same as the first embodiment in basic constitution, and an explanation will be given to portions in the fifth embodiment, which are different from those in the first embodiment. However, any coming-off preventing means of ball-latch structure is not employed in the embodiment in mounting the lower rinsing nozzle shaft 25 on the lower rinsing nozzle mount 27.

More specifically, the fifth embodiment employs, as a coming-off preventing means for the lower rinsing nozzle 22, a rack rail (restraint member) 77 arranged in the washing tank 18 of the dish washer 17. The rack rail 77 functions to place a rack (not shown), which receives therein tableware, in a predetermined position in the washing tank 18, and is constructed to be capable of coming toward and away from a top end (on a coming-off side of the mount hole 27*a*) of the lower rinsing nozzle shaft 25 inserted into the mount hole 27*a* in the lower rinsing nozzle mount 27. In addition, an adjustment bolt 78 is provided on the upper end of the lower rinsing nozzle shaft 25 to be capable of adjusting a spacing between the rack rail 77 and the upper end of the lower rinsing nozzle shaft 25.

With the above nozzle structure according to the fifth embodiment, the rack rail 77 is made in the state of enabling placing thereon a rack with the lower rinsing nozzle 22 mounted on the lower rinsing nozzle mount 27, whereby the rack rail 77 comes near to (abuts against) the upper end of the lower rinsing nozzle shaft 25 to prevent the shaft 25 from moving upward. Thus, even if any forces tending to push the lower rinsing nozzle 22 upward are applied during the washing operation, upward movements of the lower rinsing nozzle shaft 25 are prevented by the rack rail 77, so that the lower rinsing nozzle 22 is assuredly prevented from coming off during the operation. Also, when the lower rinsing nozzle 22 is to be removed from the lower rinsing nozzle mount 27, only separation of the rack rail 77 from the upper end of the lower rinsing nozzle shaft 25 as shown in FIG. 20 enables simply removing the lower rinsing nozzle 22 from the lower rinsing nozzle mount 27.

Incidentally, a rack (restraint member) placed on the rack rail may be used as a coming-off preventing means for the lower rinsing nozzle. More specifically, a preferable coming-off preventing means for the lower rinsing nozzle during the washing operation can be achieved by setting a rack so that a bottom surface of the rack comes near (abuts against) the upper end of the lower rinsing nozzle shaft when the rack is placed on the rack rail. Further, with the arrangement, in which the lower rinsing nozzle shaft is held from above by the rack rail and the rack, holding of the shaft by means of the rack rail and the rack can attain complete mounting of the shaft even when the shaft has not been completely mounted on the nozzle mount.

The nozzle structure according to the present invention is not limited to embodying of the lower rinsing nozzle but can be employed as a mount structure for the upper rinsing nozzle or the upper and lower washing nozzles. In addition, it is possible in the present invention to use in combination the coming-off preventing means according to the respective embodiments.

What is claimed is:

1. A nozzle structure for a dish washer for washing tableware with washing water and rinsing water jetted from nozzle arranged in a washing tank, said nozzle structure comprising:

a shaft arranged on said nozzle;

a nozzle mount provided in said washing tank and formed with a mount hole, which permits removable insertion of said shaft, and a coming-off preventing means for detachably preventing said shaft inserted into said mount hole of said nozzle mount from coming off, wherein said coming-off preventing means comprises a fitting groove formed in an outer periphery of said shaft, latch balls projectively arranged in a plurality of latch holes opening in an inner wall of said mount hole of said nozzle mount, and an elastic member for biasing said latch balls so that said latch balls ordinarily project from said latch holes, and wherein when said shaft is inserted into said mount hole, said latch balls are fitted into said fitting groove, so that said nozzle is mounted on said nozzle mount.

2. The nozzle structure in a dish washer according to claim 1, wherein said coming-off preventing means comprises a restraint member which releasably abuts against an upper end of said shaft inserted into said mount hole for preventing said shaft from coming off.

3. The nozzle structure in a dish washer according to claim 2, wherein said restraint member allows said shaft coming out from the mount hole when the restraint member is released from abutment with the shaft.

4. The nozzle structure for a dish washer according to claim 1, wherein said coming-off preventing means comprises an engaged portion arranged on said shaft and an engaging member engageable with said engaged portion, said engaging member being located in a non-engagement position when said washing water, rinsing water and the like are not supplied, and being displaced to an engagement position where it is engaged by said engaged portion when said washing water, rinsing water and the like are supplied.

5. The nozzle structure for a dish washer according to claim 1, wherein said coming-off preventing means comprises a first fitting means grooved on said shaft and a second fitting means provided in said mount hole of said nozzle mount to be capable of fitting into said first fitting means.

6. The nozzle structure for a dish washer according to claim 5, wherein said shaft is inserted into said mount hole to thereby fit said first fitting means and said second fitting means so that said nozzle is mounted on said nozzle mount, and said shaft is pulled out of said mount hole to thereby release a fitting between said first fitting means and said second fitting means so that said nozzle is removed from said nozzle mount.

7. The nozzle structure for a dish washer according to claim 5, wherein said first fitting means comprises a fitting groove formed in an outer periphery of said shaft, and said second fitting means comprises latch balls projectively arranged in a plurality of latch holes opening in an inner wall of said mount hole and an elastic member for biasing said latch balls so as to ordinarily project from said latch holes, and wherein said shaft is inserted into said mount hole to thereby said latch balls are fitted into said fitting groove so that said nozzle is mounted on said nozzle mount.

8. The nozzle structure for a dish washer according to claim 7, further being equipped with a restraint member which is located in a retracted position where said latch balls are allowed to move away from said fitting groove in a state without water pressure of said washing water, rinsing water or the like, and which is moved to a restraint position where said latch balls are restrained from moving away from said fitting groove in a state with water pressure applied by said washing water, rinsing water or the like.

9. The nozzle structure for a dish washer according to claim 1, wherein said coming-offpreventing means comprises a restraint member provided on said shaft to be fitted onto said nozzle mount and a pressure contact member provided on said nozzle mount, and wherein said pressure contact member is located in a non-pressure contact position, where it faces said restraint member on said shaft, in a state without water pressure of said washing water, rinsing water or the like, and said pressure contact member is displaced to a pressure contact position, where said restraint member is caused to abut against said nozzle mount, in a state with water pressures applied by said washing water, rinsing water or the like.

10. The nozzle structure for a dish washer according to claim 1, wherein an operating lever with an acting portion is turnably arranged on nozzle holder provided on said nozzle, and wherein said acting portion projecting from said nozzle holder toward the side of said nozzle mount is caused by turning of said operating lever to abut against an upper end of this nozzle mount to thereby bias said shaft in a direction where said shaft is pulled out of said mount hole.

* * * * *